US006634325B1

(12) United States Patent
Adams

(10) Patent No.: US 6,634,325 B1
(45) Date of Patent: Oct. 21, 2003

(54) FUEL INJECTION SYSTEM FOR LINEAR ENGINES

(76) Inventor: Joseph S. Adams, 481 Beaver Point Road, Salt Spring Island, British Columbia (CA)

( * ) Notice: Subject to any disclaimer, the term of this patent is extended or adjusted under 35 U.S.C. 154(b) by 0 days.

(21) Appl. No.: 10/138,915

(22) Filed: May 3, 2002

(51) Int. Cl.[7] ..... F02B 71/00

(52) U.S. Cl. ..... 123/46 R; 123/465 C; 227/10

(58) Field of Search ..... 123/46 R, 46 A, 123/46 SC, 46 H; 227/10

(56) References Cited

U.S. PATENT DOCUMENTS 4,365,471 A 12/1982 Adams ..... 60/39.76
4,665,868 A 5/1987 Adams ..... 123/46
4,717,060 A 1/1988 Cotta ..... 227/10
4,759,318 A 7/1988 Adams ..... 123/46.5
5,377,628 A 1/1995 Adams ..... 123/41.31
5,540,194 A 7/1996 Adams ..... 123/46 R
6,016,946 A 1/2000 Phillips et al. ..... 227/10
6,045,024 A 4/2000 Phillips ..... 227/130

*Primary Examiner*—Noah P. Kamen
(74) *Attorney, Agent, or Firm*—Eugene Stephens & Associates; Thomas B. Ryan

(57) ABSTRACT

The fuel injector system of this invention is controlled via a diaphragm or piston referenced to a pressure pulse from a linear engine such as may be used for gas-powered fastening tools to inject fuel to the engine.

30 Claims, 17 Drawing Sheets

FUEL INJECTION SYSTEM FOR LINEAR ENGINES

FIELD OF THE INVENTION

This invention relates generally to the field of fuel injectors for linear engines of combustion gas-powered tools such as those used to drive fasteners.

BACKGROUND OF THE INVENTION

Combustion-powered fastening tools as are currently manufactured utilize fuel injection systems that are mechanically actuated as the tool is pushed onto the work piece. This causes problems as the operator may touch the work piece with the tool a number of times before he is ready to fire a fastener, and the resulting multiple injections cause an over-rich mixture resulting in the failure of the tool to fire. According to one embodiment of this invention, a diaphragm or piston is used to automatically actuate the fuel injector using combustion pressure or air pressure generated below the piston to provide the proper injection only if the tool has actually fired. Another embodiment of this invention further delays the injection until the tool's trigger is released.

Another object of this invention is to integrate this diaphragm-or piston-operated fuel injection system into an existing actuator currently being used to control the exhaust valve operation as described in U.S. Pat. Nos. 4,759,318 and 4,665,868, which are both hereby incorporated by reference. A further object of this invention is to provide a fuel injection portion valving system that has no critical seals or sliding components, such as are described in U.S. Pat. No. 4,365,471 and in U.S. Pat. Nos. 6,016,946 and 6,045,024. It has been found that as well as requiring precise manufacturing techniques, these linear gating or sliding component valves are prone to wear, leakage, and lubrication problems.

SUMMARY OF THE INVENTION

In accordance with one or more embodiments of the present invention, there is provided a fuel injection system for linear engines of gas-powered tools comprising a combustion chamber, the power from which drives a piston. The system also comprises a fuel source communicating through a fuel injection valve with the combustion chamber. The fuel injection valve moves between (a) a first position allowing a charge of fuel from the source to pass to a fuel plenum while simultaneously blocking passage of the fuel from the fuel plenum to the combustion chamber and (b) a second position allowing the charge of fuel in the plenum chamber to pass to the combustion chamber while simultaneously blocking off passage of fuel from the fuel source to the fuel plenum chamber. A diaphragm actuator is provided for the injection valve, the diaphragm being actuated by compressed air beneath the piston to overcome a bias of the diaphragm normally keeping it in the second position.

In an alternative embodiment, the fuel injection valve is divided into separately operated fill and dump valves. The fill valve is operated by a similar diaphragm actuator for filling the fuel plenum in response to a tool firing. The dump valve, which interrupts the flow of fuel from the plenum chamber to the combustion chamber, operates independently of the diaphragm actuator to further control the timing of the fuel injection. Preferably, the dump valve is linked to the tool's trigger so that the dump valve opens when the trigger is released. Timing the fuel injection to the release of the trigger assures that the combustion chamber is adequately cleared of unwanted combustion by-products before new fuel is added.

In either embodiment of the present invention, the diaphragm actuator for the injection valve or the fill valve portion of the injector valve can be actuated by combustion gases from the combustion chamber instead of by compressed air beneath the piston. The system according to the present invention provides proper injection of fuel to the combustion chamber only after the tool has been fired.

BRIEF DESCRIPTION OF THE DRAWINGS

These and other objects and advantages of the invention will become apparent upon reading the following detailed description and upon referring to the drawings.

Figure 1:
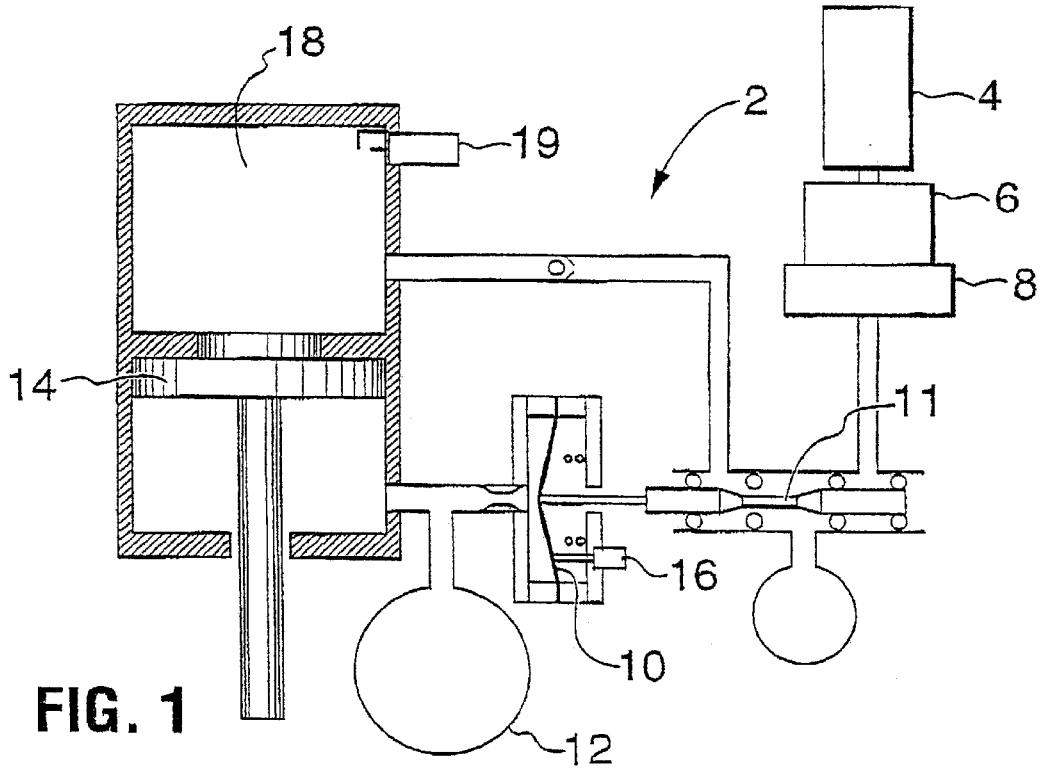
FIGS. 1–4 are schematic views of an automatic fuel injector system in accordance with the present invention in successive stages of operation.

While the invention will be described in conjunction with illustrated embodiments, it will be understood that it is not intended to limit the invention to such embodiments. On the contrary, it is intended to cover all alternatives, modifications, and equivalents as may be included within the spirit and scope of the invention as defined by the appended claims.

DETAILED DESCRIPTION OF THE PREFERRED EMBODIMENTS

In the drawings, similar features have been given similar reference numerals.

In order to accurately measure and inject small amounts of fuel to a combustion chamber such as may be used in gas-powered fastening tools, it is desirable to first convert the liquefied petroleum gas, such as propane or Mapp gas, from a removable container into its vapor state so that it can be more easily measured than as a liquid. This fuel is then delivered to a fill valve under pressure which upon actuation first fills a portion chamber, then closes the fill valve, and then opens a dump valve which empties the excess pressure in the portion chamber to the combustion chamber providing an accurate fuel injection metering system. Examples of these systems can be seen in U.S. Pat. Nos. 4,365,471; 6,016,946; and 6,045,024, which are hereby incorporated by reference. These earlier systems rely on manual actuation and are therefore slow in operation.

FIG. 1 shows the basic configuration of the fuel injection system 2 according to the present invention whereby a container 4 of LPG (liquid petroleum gas) is attached to a vaporization chamber 6 which communicates with a regulator 8 as described in my co-pending patent application Ser. No. 10/021,445, entitled "Vapor-separating Fuel System Utilizing Evaporation Chamber", which is hereby incorporated by reference, or other pressure-regulated fuel vapor supply system. An actuator diaphragm 10 (or similar piston actuator) is connected to a gating-type portioning valve 11 (fuel injection valve) as more fully described in U.S. Pat. No. 4,365,471. The actuator diaphragm 10 is in communication with an air plenum (portion) chamber 12, which is pressurized by the air displaced by the underside of a tool piston 14 during its power stroke. A button 16 attached to the diaphragm 10 can be manually actuated to inject fuel into the combustion chamber 18 having an igniter 19 for initiating the first cycle of the tool.

Figure 2:
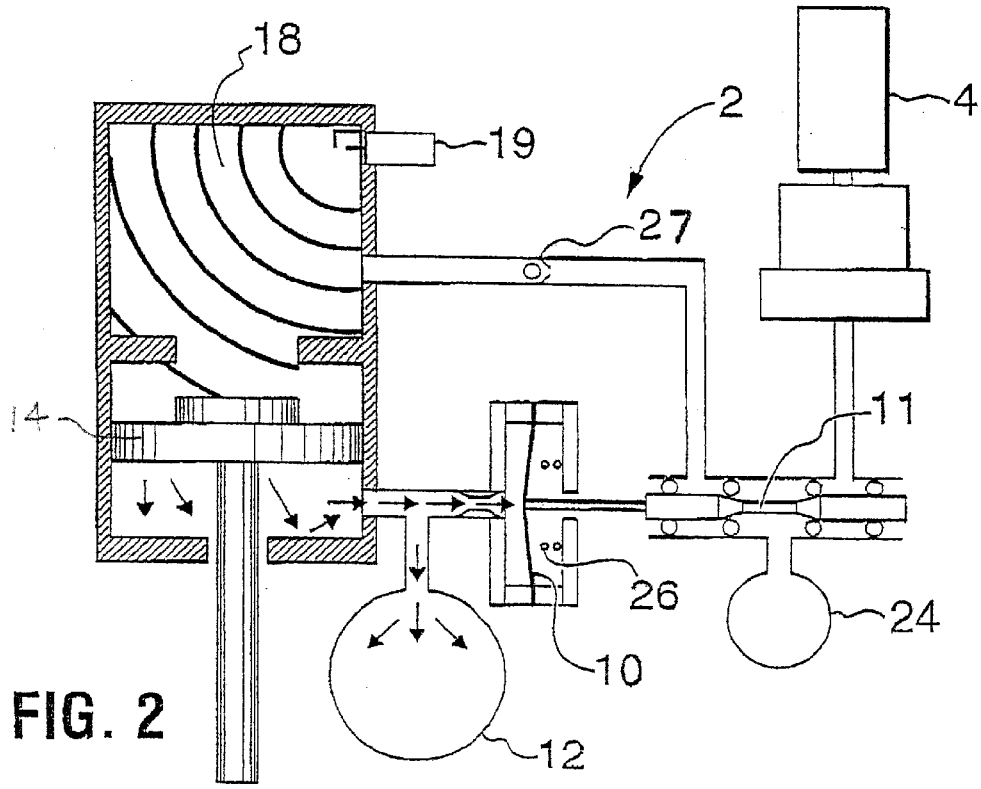

FIG. 2 shows the fuel/air mixture being ignited and the tool piston 14 moving downward compressing the air below it and the pressure being communicated to the actuator diaphragm 10.

Figure 3:
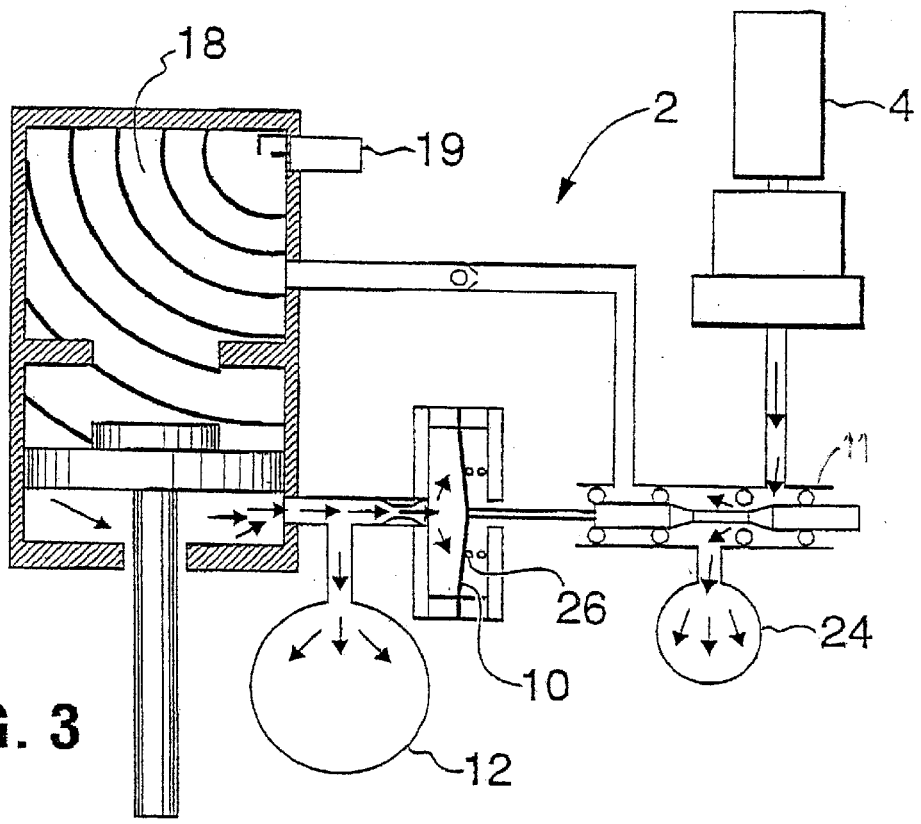

FIG. 3 shows the fuel injector valve 11 being actuated by movement of the actuator diaphragm 10 causing a fuel plenum (portion) chamber 24 to be pressurized by the incoming vaporized fuel.

Figure 4:
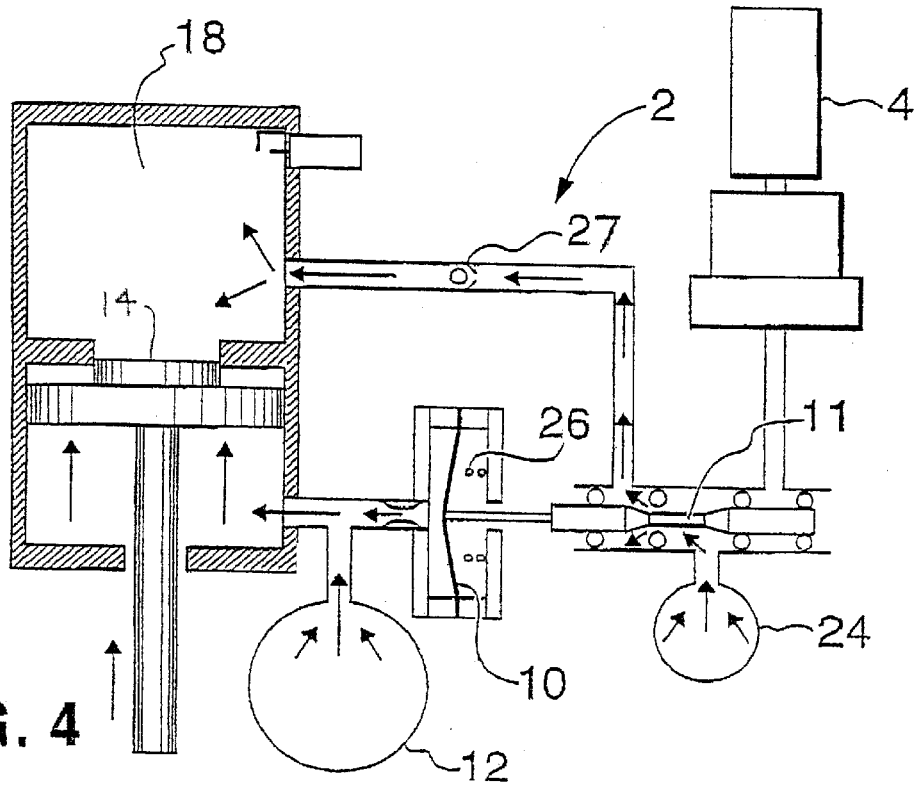

FIG. 4 shows the tool piston 14 returning, causing the plenum air pressure to drop and allowing the spring 26 biasing the actuator diaphragm 10 to return the injector valve 11 to its original position closing the passageway from the fuel supply 4 to the fuel plenum chamber 24 and opening a passageway from the fuel plenum chamber 24 to the combustion chamber 18. The fuel plenum chamber 24 is connected to the combustion chamber 18 via a check valve 27 as disclosed in U.S. Pat. No. 4,717,060, which is hereby incorporated by reference, for automatically injecting fuel into the combustion chamber 18 as the piston 14 returns to its uppermost position.

Figure 5:
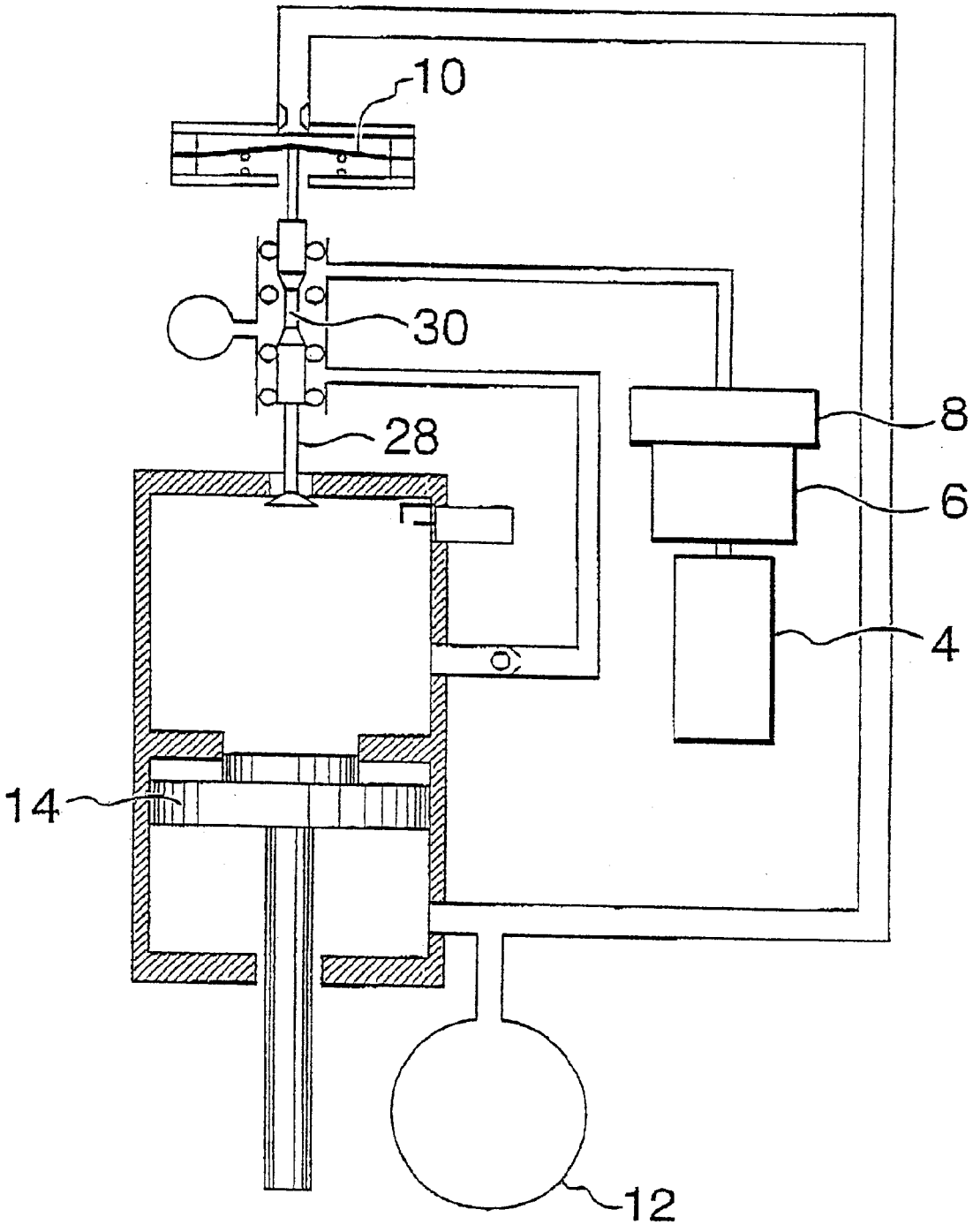
FIG. 5 illustrates a modification of the fuel injector system in accordance with the present invention in which a fuel injector also controls the operation of a combustion chamber exhaust valve.

FIG. 5 shows that this diaphragm actuator 10 can be alternatively integrated into an existing exhaust valve 28 as described in U.S. Pat. Nos. 4,759,318 and 4,665,868. In this system, air pressure from below the piston 14 is used to control the exhaust valve 28 opening which is coincident with a preferred operating time frame of the fuel injector.

As mentioned above, a gating or other sliding valve type 30 can be used as an injector; however, these can be problematic. In an alternative embodiment illustrated in FIGS. 6–9, this invention allows for and facilitates a valving system utilizing a common tire type or other non-sliding valve types 32 to be integrated into the system so that there are no critical sliding seals required to hold fuel under pressure.

Figure 6:
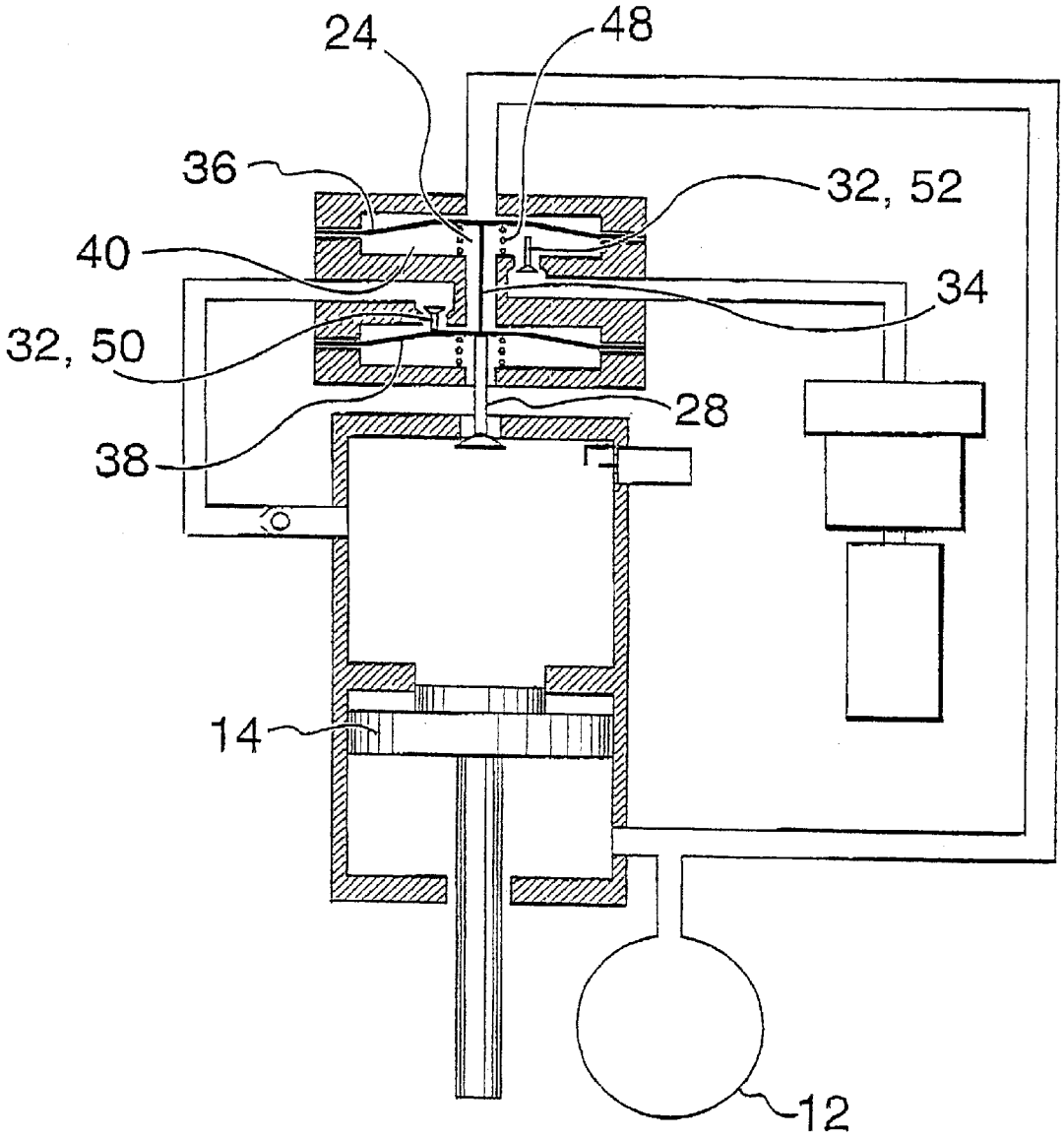
FIGS. 6–9 are schematic views of a further modification of the fuel injection system according to the present invention in which a double diaphragm arrangement operates within a fuel plenum/portion chamber during successive stages during the cycle of operation of the combustion chamber.

FIG. 6 shows the fuel valving details whereby its fuel portion chamber 24 is contained between a double diaphragm arrangement 34. The two diaphragms 36 and 38 are tied together forming a portion chamber volume 40 between them. These diaphragms are used to actuate fill and dump valves 32 of the common tire type. The upper diaphragm 36 is in communication with the plenum 12 air supply. If desired to more fully control the opening and closing time of the fuel injector, a check valve/orifice combination 42 (FIG. 7) can be used to allow rapid operation of the system whereby air flow to the actuating diaphragm 10 passes through an orifice 44 and past a check valve 46 during compression of the plenum and only through the orifice 44 when the pressure decreases during the cycle. In a preferred embodiment as shown, this double diaphragm arrangement 34 is also connected to the exhaust valve 28 of the tool as described in U.S. Pat. Nos. 4,759,318 and 4,665,868. When in its rest position, a spring 48 biases the diaphragm 34 into its uppermost position which holds a dump valve 50 open and allows the fill valve 52 to remain closed under its own spring tension.

Figure 7:
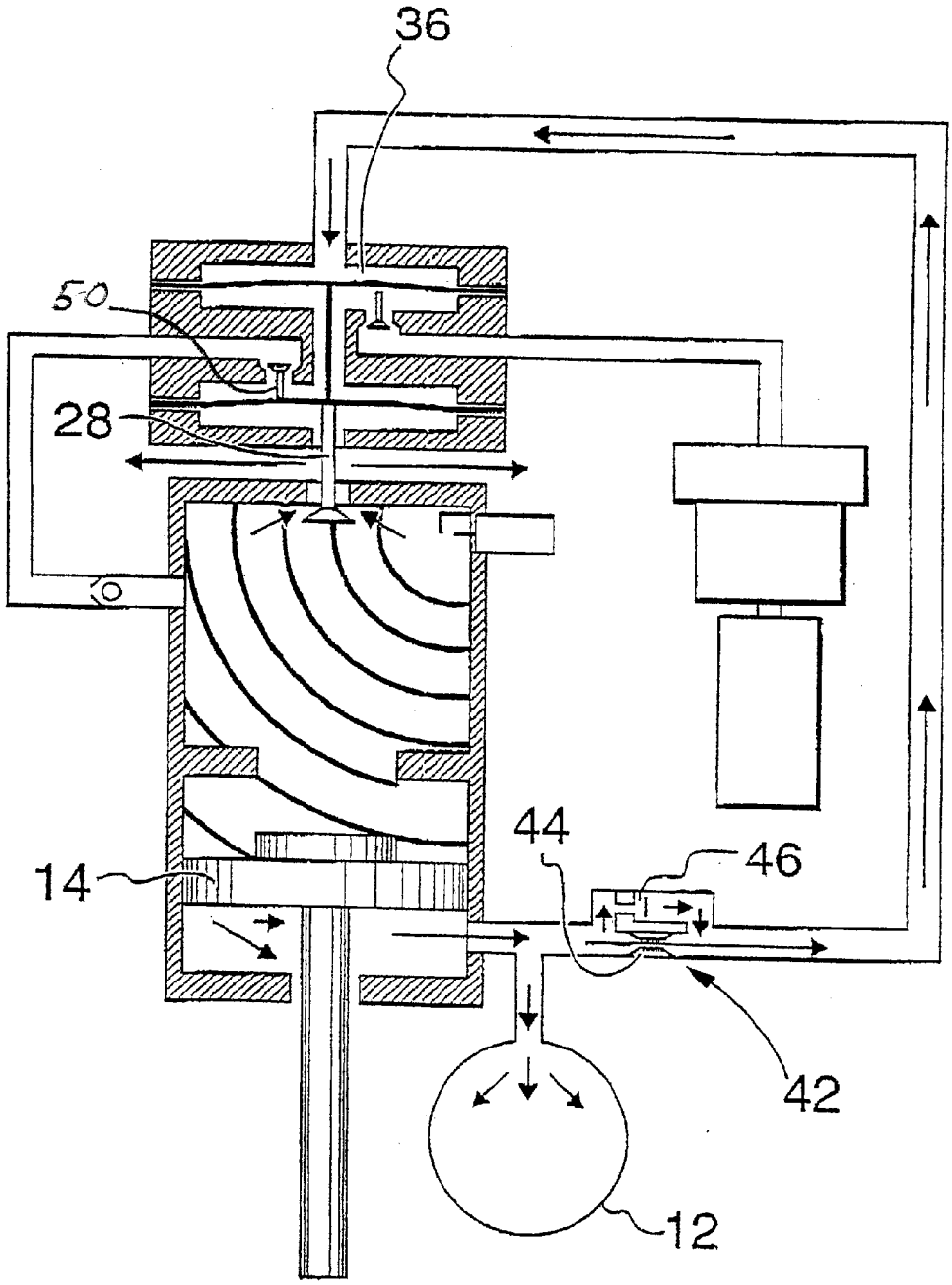

FIG. 7 shows the system in operation whereby plenum air pressure has risen due to a power stroke of the tool causing the upper diaphragm 36 to begin moving, opening the exhaust valve 28 and closing the dump valve 50.

Figure 8:
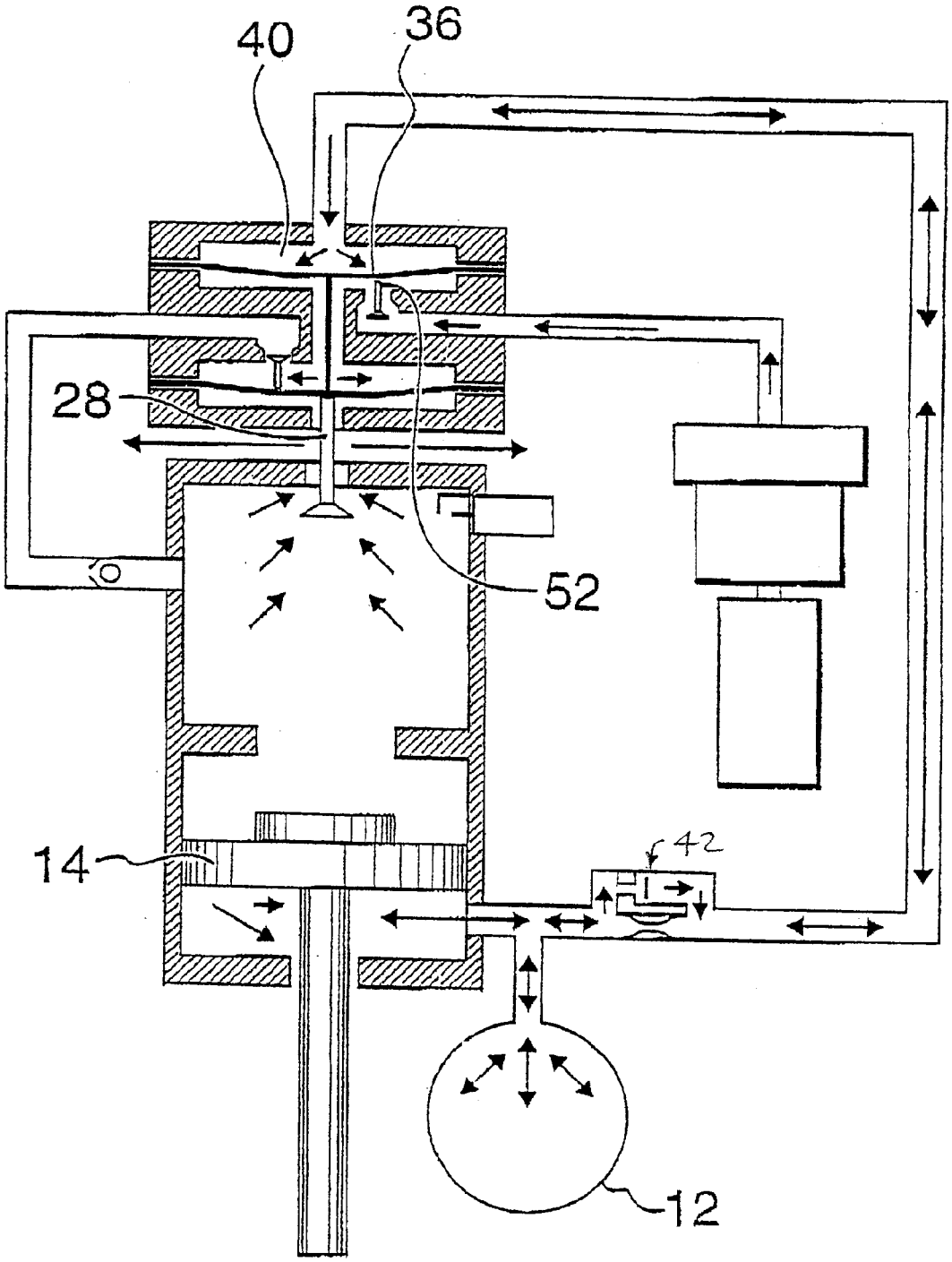

FIG. 8 shows the diaphragm 36 continuing to open the exhaust valve 28 and actuating the fill valve 52 causing vaporized fuel under pressure to flow through the fill valve and into the portion chamber volume 40 between the two diaphragms.

Figure 9:
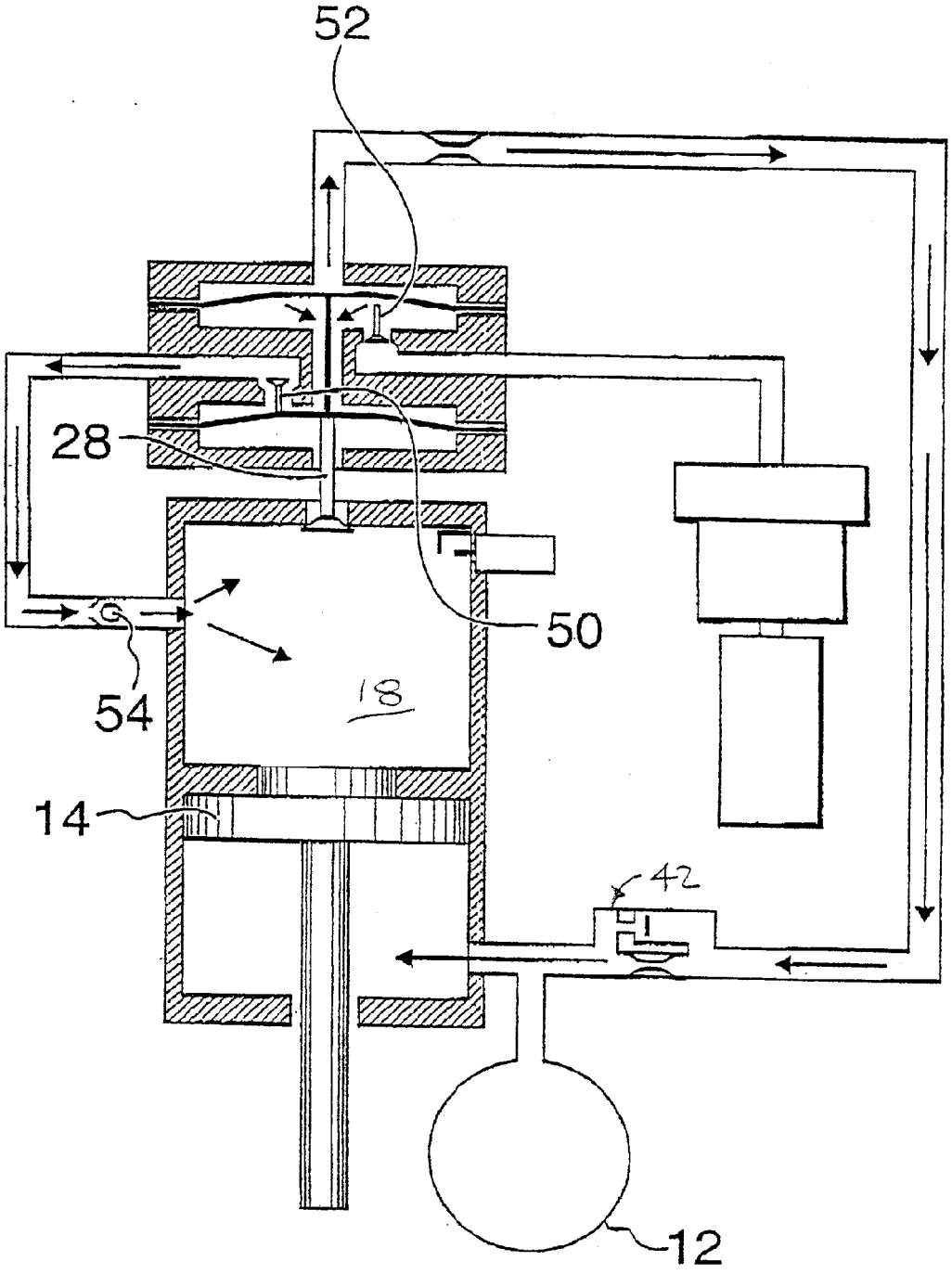

FIG. 9 shows the diaphragms returning to their uppermost position, first closing the fill valve 52 and then opening the dump valve 50 causing fuel to be injected through a check valve 54 into the combustion chamber 18 as the exhaust valve 28 closes.

Figure 10:
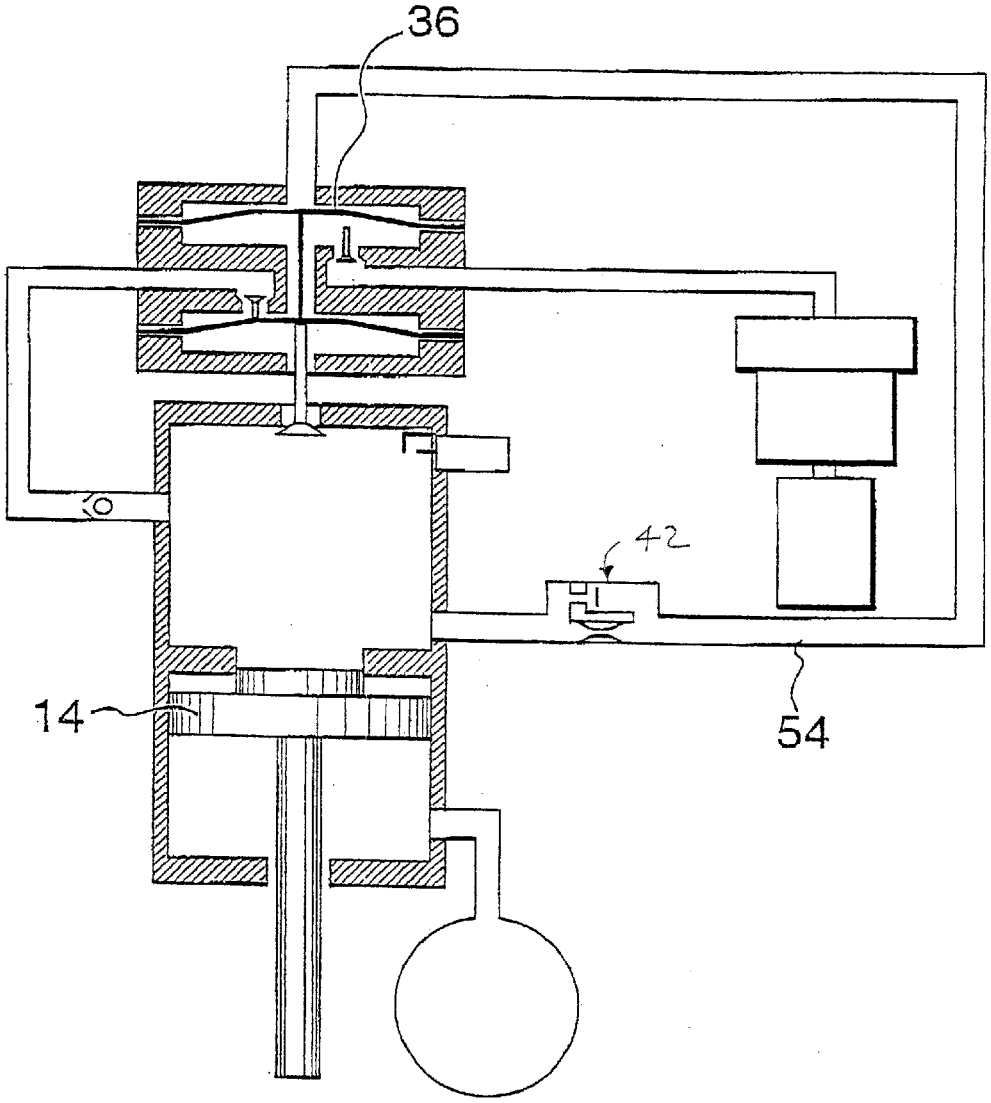
FIG. 10 illustrates yet another modification of the system of FIGS. 6–9 where the fuel injector diaphragms are actuated by combustion pressure rather than plenum pressure.

FIG. 10 shows that the source of signal pressure to the fuel injector system can also be combustion pressure, fed to diaphragm 36 through line 54, rather than plenum air pressure. This may be particularly useful in high-speed systems where the pressure signal is required to be as early as possible.

Figure 11:
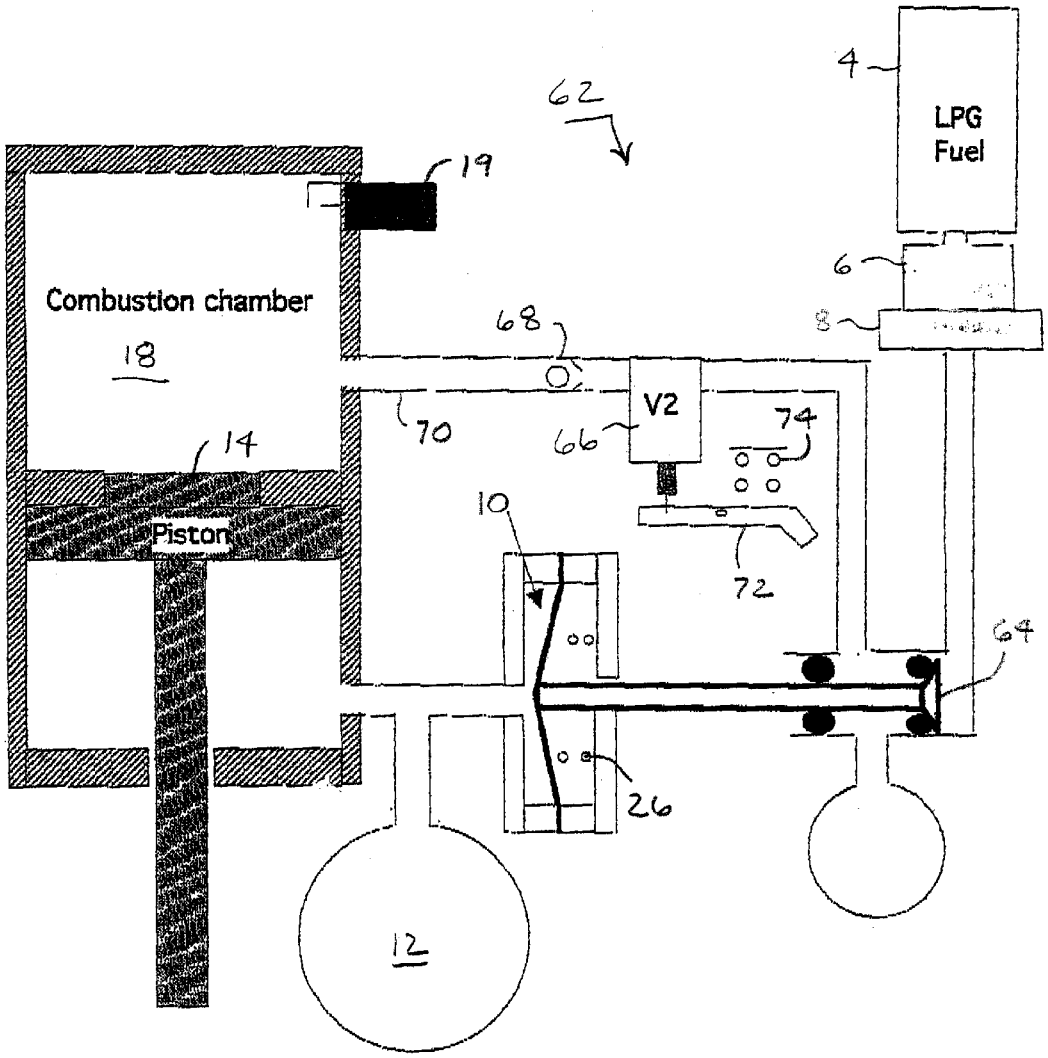
FIGS. 11–13 are schematic views of an alternative fuel injection system in successive stages of operation where a fuel injector valve is divided into an automatically operated fill valve and a manually operated dump valve.
Figure 12:
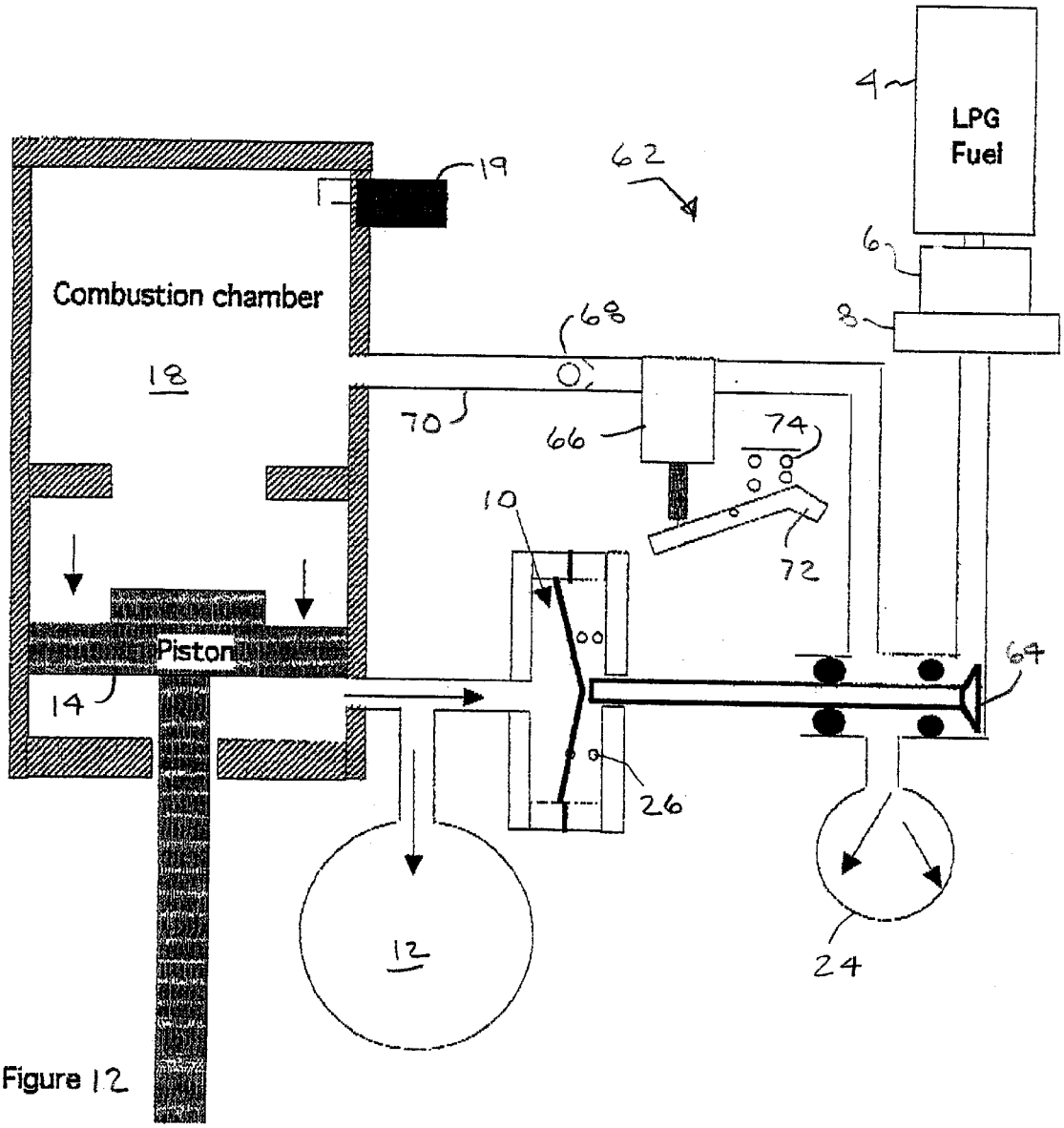
Figure 13:
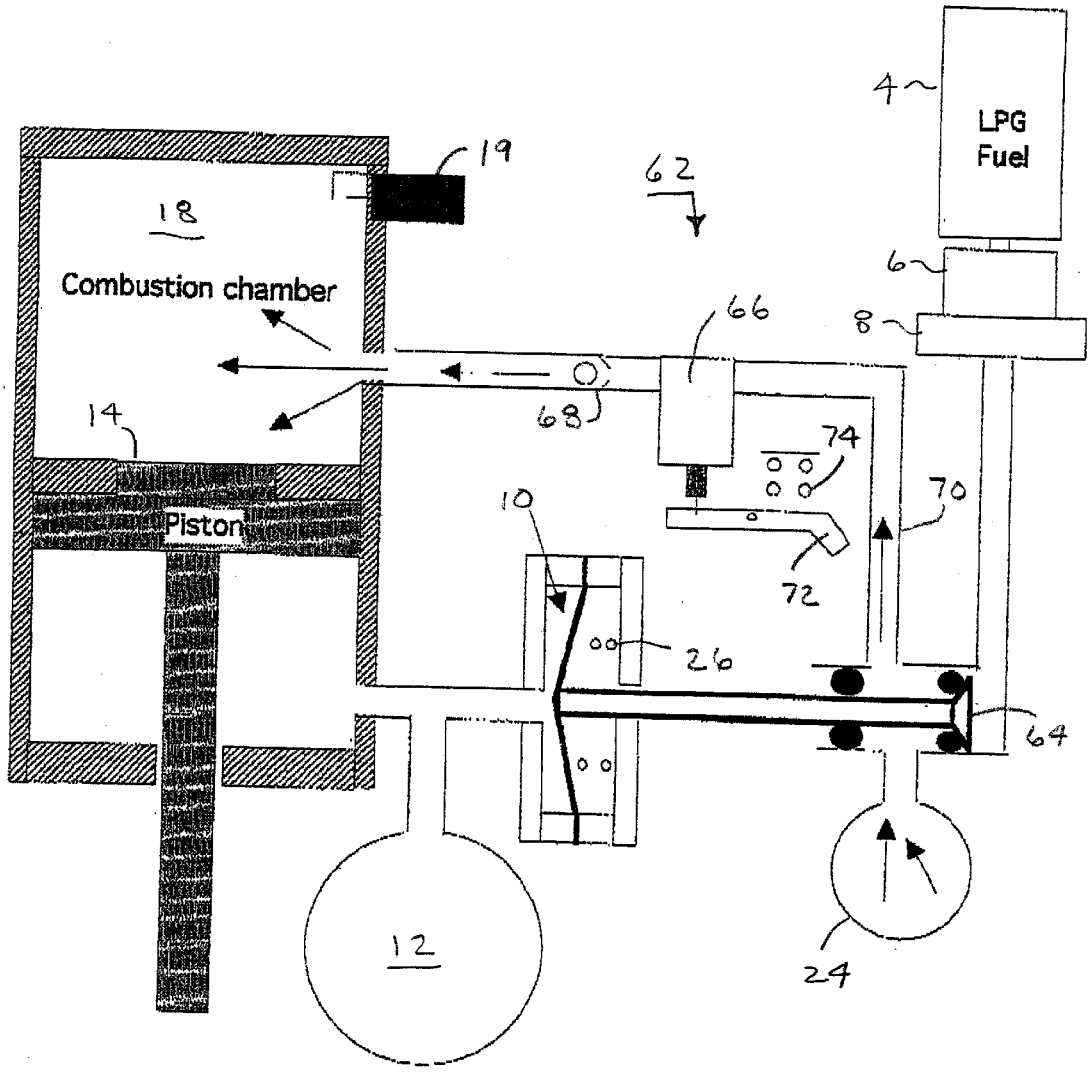

An alternative fuel injection system 62 with a delayed release of fuel into the combustion chamber 18 is shown in FIGS. 11–13. Similar to the fuel injection system 2, the container 4 of LPG (liquid petroleum gas) is attached to the vaporization chamber 6 which communicates with the regulator 8 for supplying fuel in a vapor state to the fuel plenum chamber 24.

As shown in FIG. 12, a downward stroke of the tool piston 14 fills the air plenum chamber 12 and displaces the actuator diaphragm 10. The displacement of the actuator diaphragm 10 opens a positive seating (e.g., poppet) fill valve 64, causing the fuel plenum chamber 24 to be appropriately filled and pressurized by the incoming vaporized fuel. A manually actuated dump valve 66 and a check valve 68 interrupt a passageway 70 between the fuel plenum chamber 24 and the combustion chamber 18. A tool trigger 72 is attached to the dump valve 66 for manually operating the dump valve 66. Normally, the dump valve 66 is biased to an open position by a spring 74 connected to a tool trigger 72. However, depressing the trigger 72 moves the dump valve 66 to a closed position blocking the passageway 70 between the fuel plenum chamber 24 and the combustion chamber 18.

For example, when the trigger 72 is first depressed as seen in FIG. 12, the tool fires causing the downward movement of the piston 14. Air compressed by the piston 14 fills the air plenum chamber 12 and displaces the actuator diaphragm 10 for opening the fill valve 64. On the return stroke of the piston 14, the air is decompressed and the spring 26 returns the actuator diaphragm 10 along with the fill valve 64 to a closed position. The dump valve 66 remains closed until the trigger 72 is released. After the trigger 72 is released as shown in FIG. 13, the vaporized fuel in the fuel plenum chamber 24 flows through the dump valve 66 and the check valve 68 into the combustion chamber 18, readying the combustion chamber 18 for its next firing. The requirement for releasing the trigger 72 before opening the dump valve 66 assures that the combustion chamber 18 is properly cleared of any combustion by-products before new fuel is added.

Figure 14:
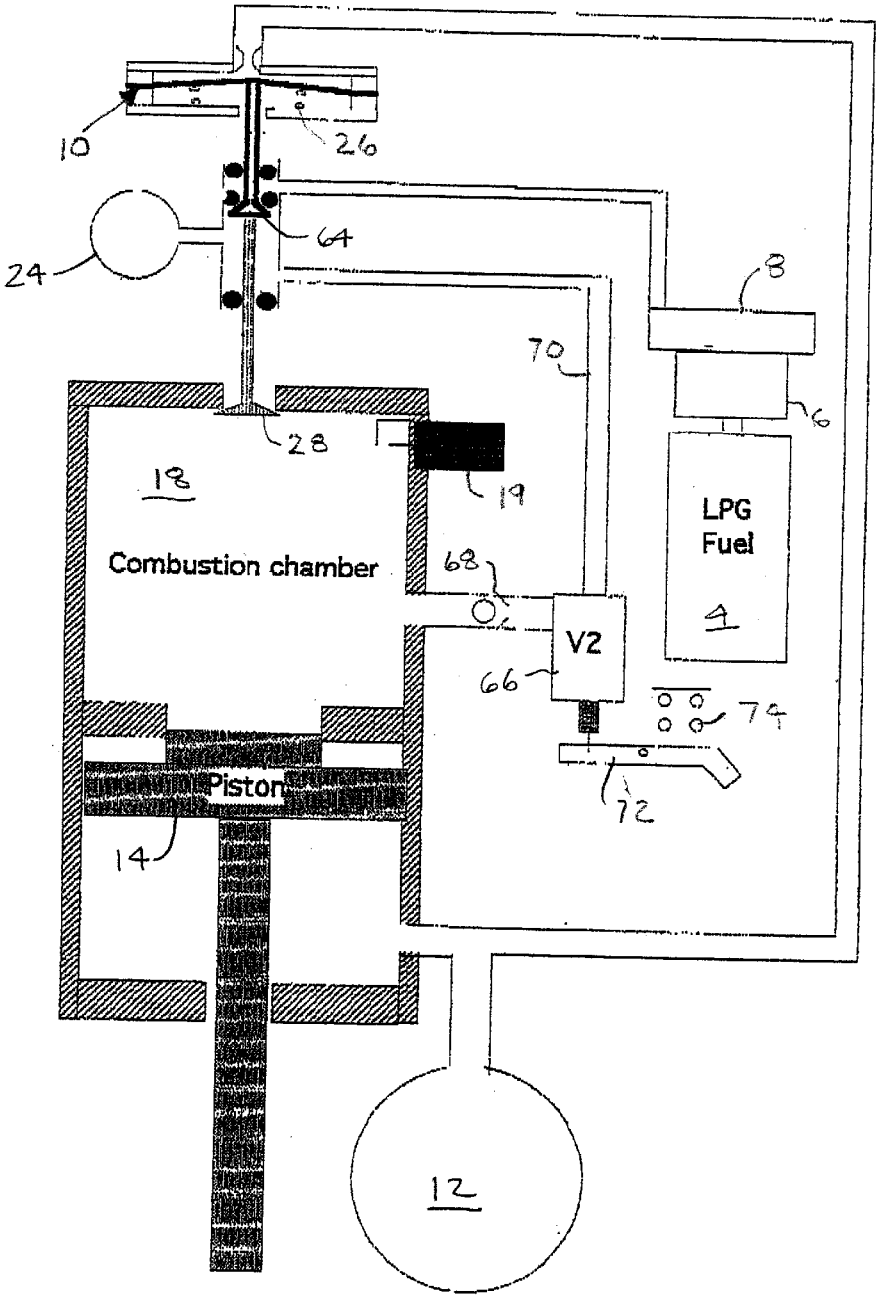
FIGS. 14–16 are schematic views of the alternative fuel injection system in successive stages of operation modified to combine control over the fill valve and an exhaust valve.

As shown in FIG. 14, the alternative fuel injection system 62 can also be modified for integration into an exhaust valve 28, where air pressure from below the piston 14 controls the opening of the exhaust valve 28 in synchronism with the operation of the fuel injector. The actuator diaphragm 10, which is responsive to the air pressure generated beneath the piston 14, is coupled to the exhaust valve 28 through the fill valve 64. Movement of the actuator diaphragm 10 in response to the down stroke of the piston 14 opens both the fill valve 64 and the exhaust valve 28. When decompressed, the spring 26 restores the actuator diaphragm 10 to its initial position at which both the exhaust valve 28 and the fill valve 64 are closed.

Figure 15:
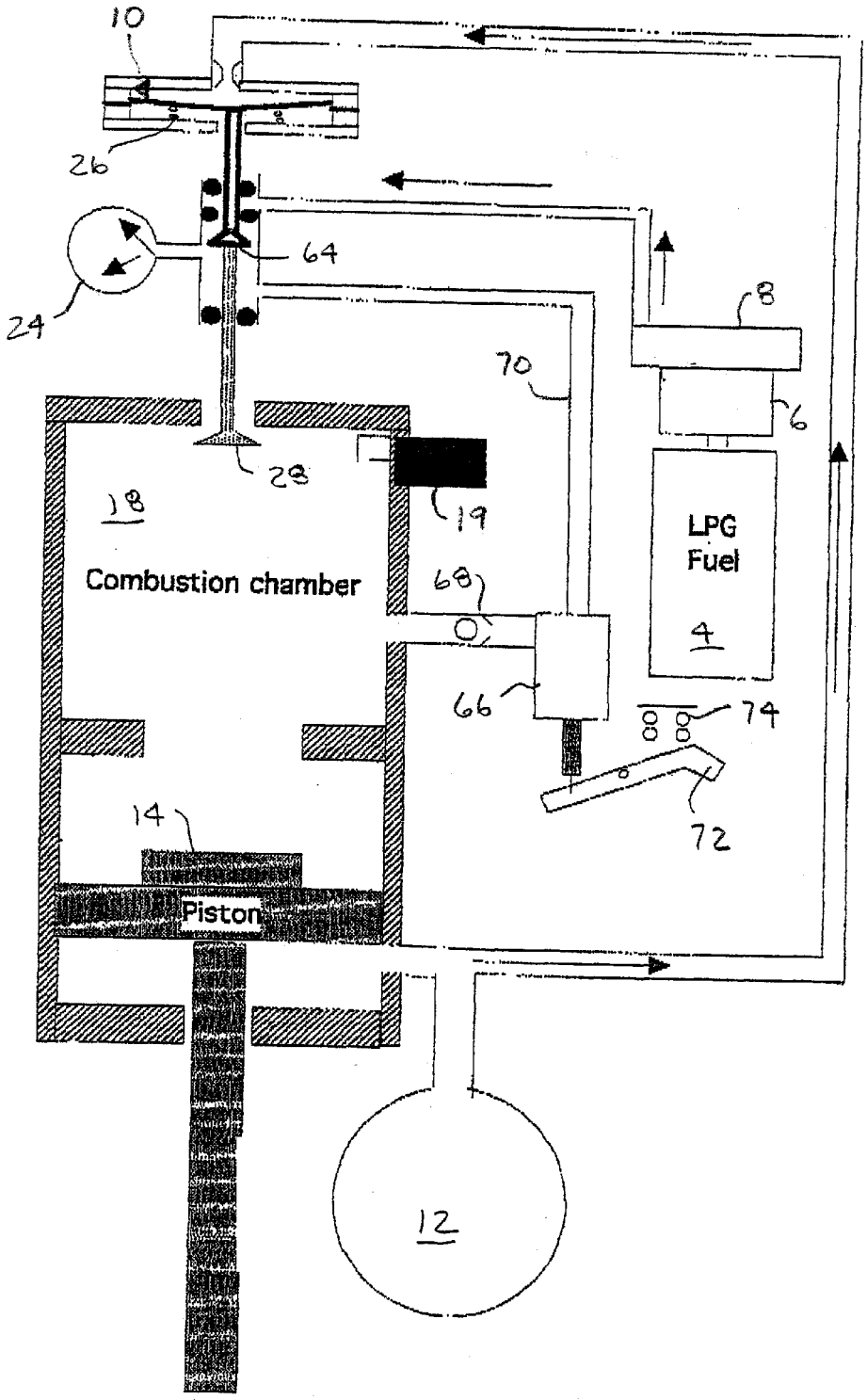
Figure 16:
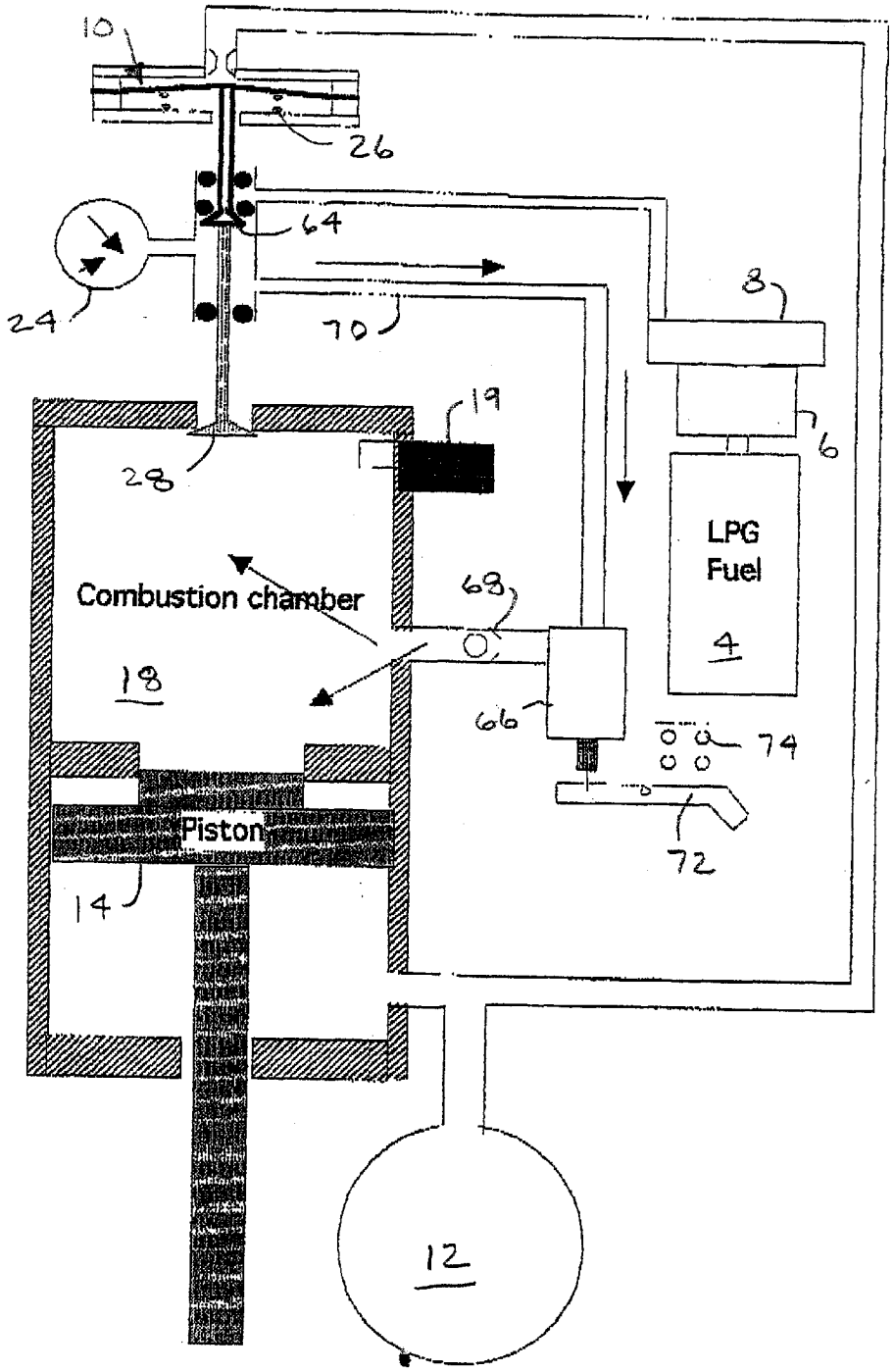

The dump valve 66 is biased open by the spring 74 attached to the tool trigger 72. However, when the trigger 72 is squeezed to initiate a firing of the tool as seen in FIG. 15, the dump valve 66 closes to prevent fuel from entering the combustion chamber 18 until the combustion chamber 18 is cleared of the by-products of combustion. When the trigger 72 is released as seen in FIG. 16, the dump valve 66 opens to allow fuel from the fuel plenum 24 to enter the combustion chamber 18.

Figure 17:
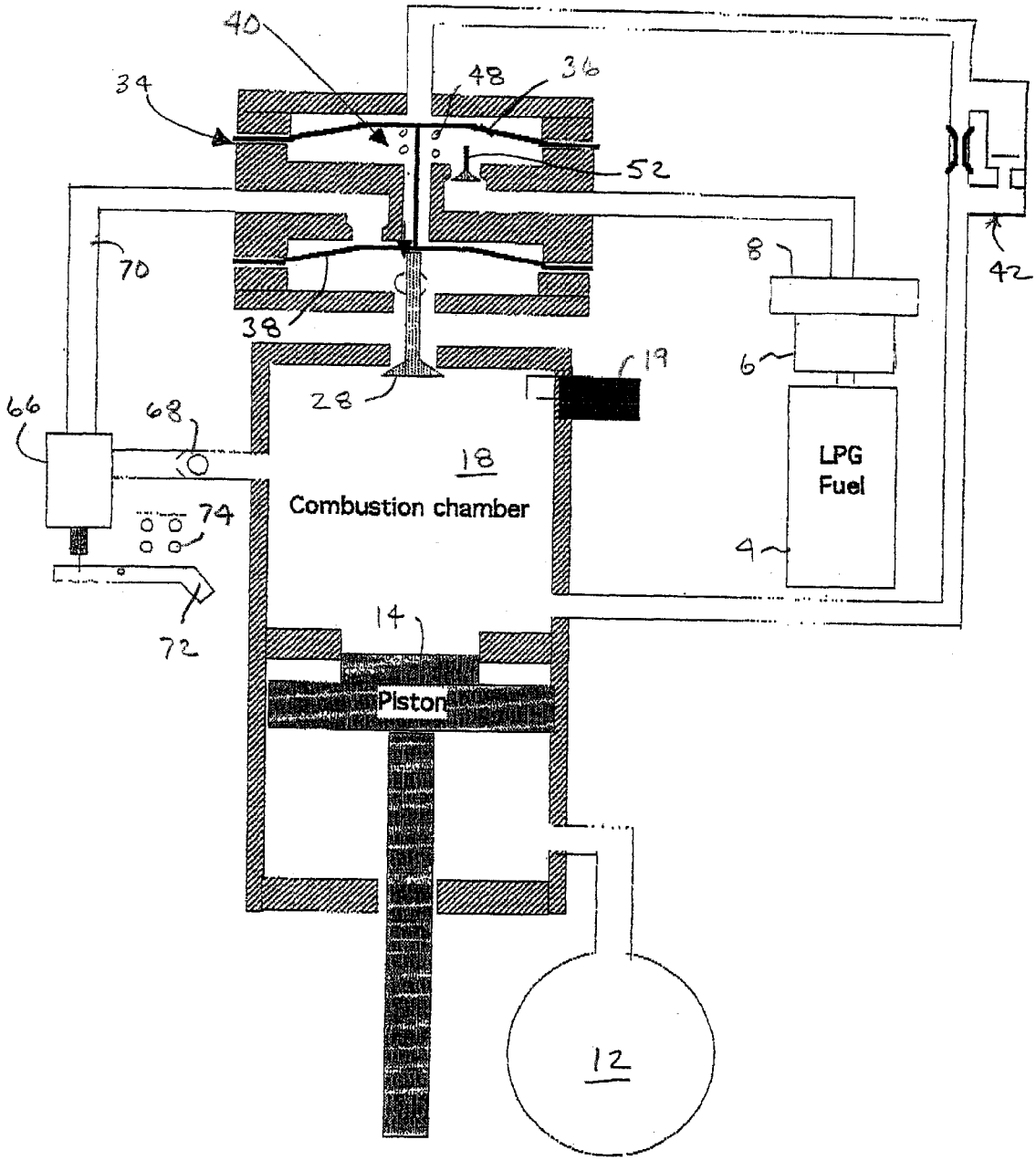
FIGS. 17–19 are schematic views of the alternative fuel injection system during successive stages of operation alternatively modified to include a double diaphragm actuator arrangement containing a fuel plenum/portion chamber.
Figure 18:
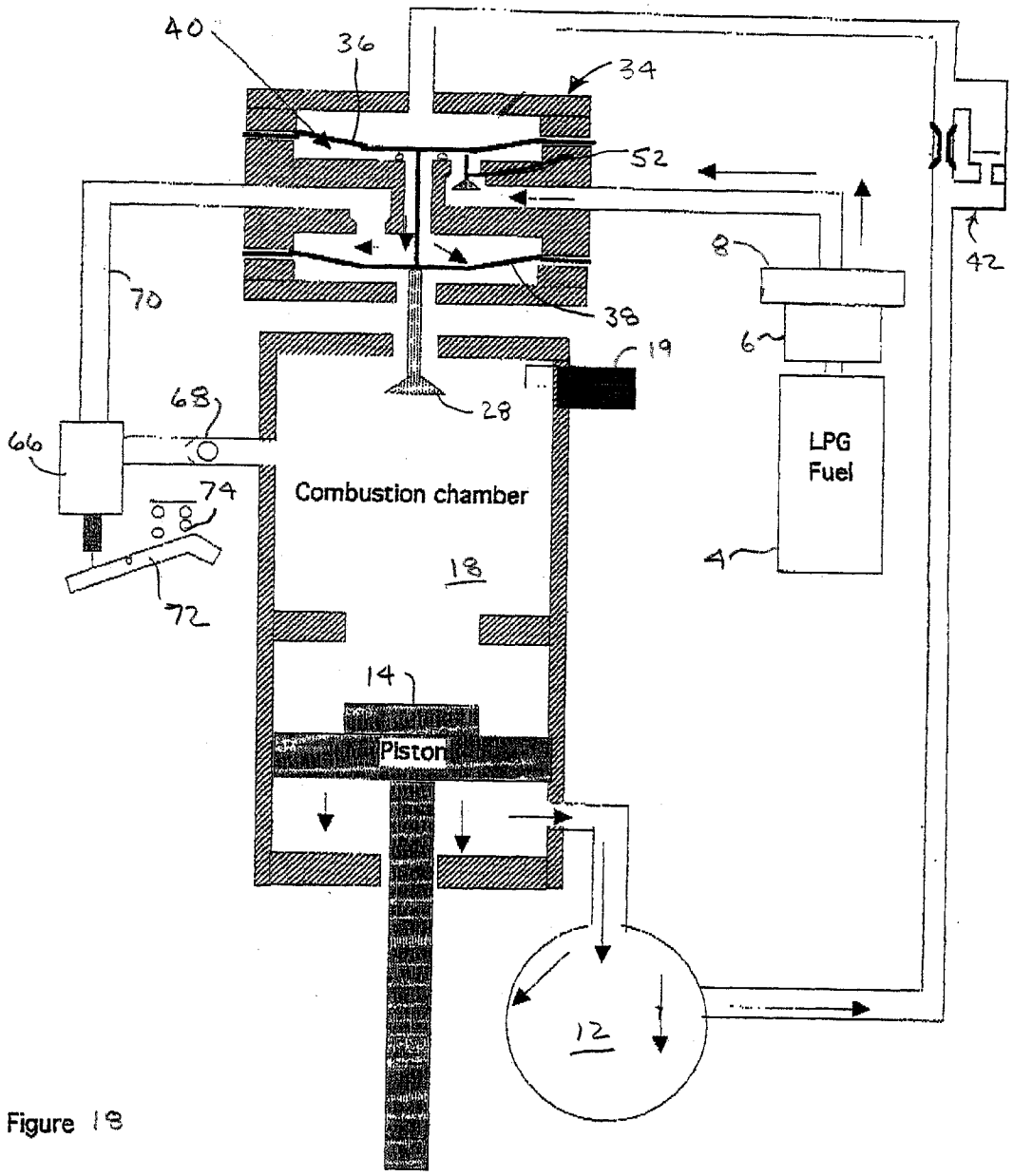
Figure 19:
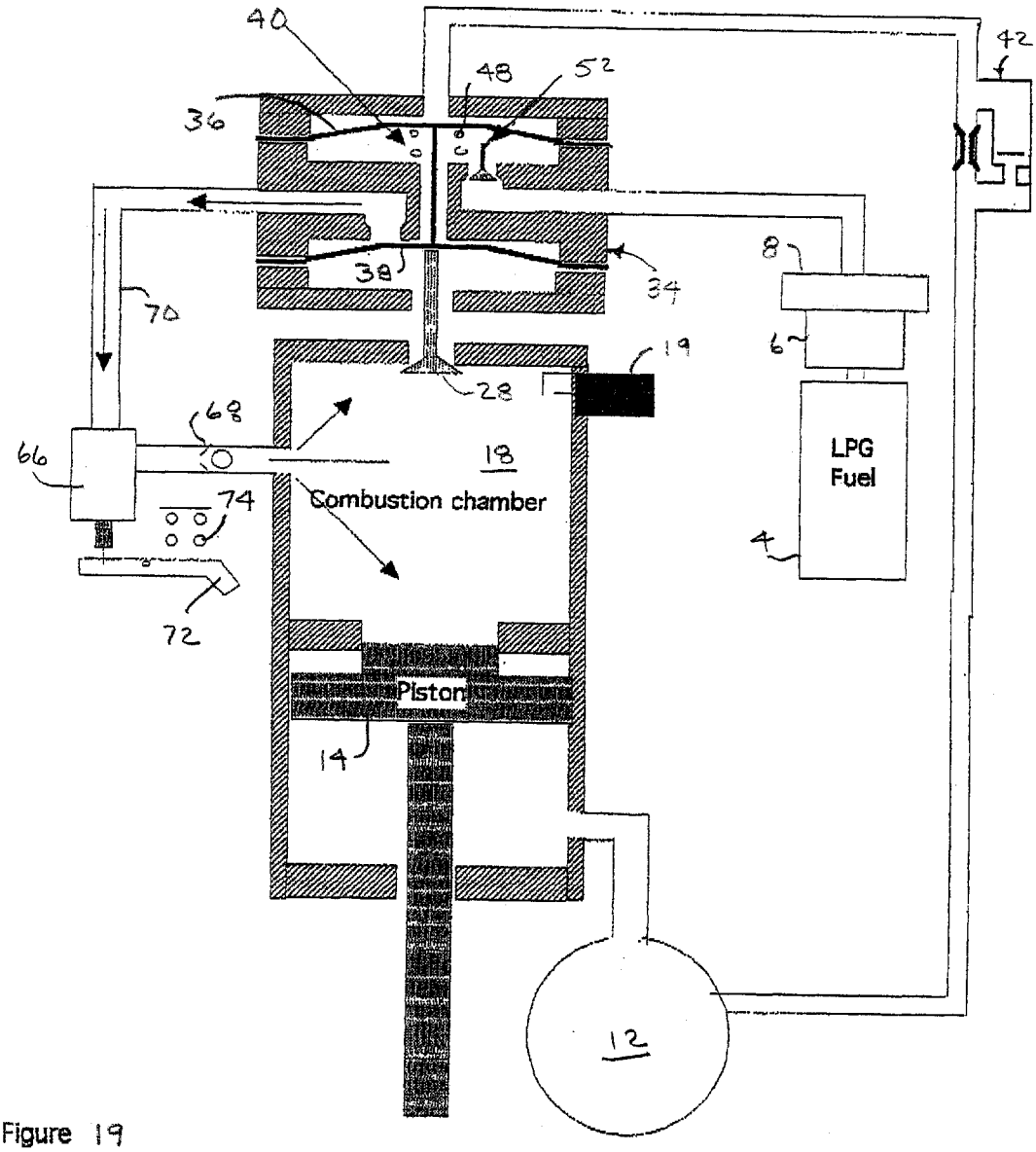

FIGS. 17–19 illustrate the substitution of the double diaphragm arrangement 34 for controlling the operation of both the exhaust valve 28 and the alternative fill valve 52. The two diaphragms 36 and 38 form between them a fuel portion chamber volume 40, which functions similar to the fuel plenum chamber 24. The upper diaphragm 36 is responsive to pressure changes of the combustion chamber 18 for opening the fill valve 52 to allow fuel to enter the fuel portion chamber volume 40. Movements of the two diaphragms 36 and 38 are coupled to each other and to the exhaust valve 28.

When the trigger 72 is depressed and the tool is fired, increased pressure in the combustion chamber 18 is communicated through a check valve/orifice combination 42 to the double diaphragm arrangement 34. The pressure applied to the double diaphragm arrangement 34 opens the fill valve 52 to pressurize the volume 40 between the diaphragms 36 and 38 with fuel and opens the exhaust valve 28 to allow for the removal of combustion by-products from the combustion chamber 18. During this portion of the firing cycle, the trigger 72 remains depressed and the dump valve 66 remains closed as shown in FIG. 18 to allow fuel to accumulate within the fuel portion chamber volume 40 without reaching the combustion chamber 18.

When the combustion chamber is evacuated and its pressure drops, the spring 48 restores the diaphragm arrangement 34 to its initial position at which both the fill valve 52 and the exhaust valve 28 are closed. Releasing the trigger 72 opens the dump valve 66 as shown in FIG. 19 for allowing fuel to pass from the fuel portion chamber volume 40 into the combustion chamber 18. Once the fuel enters the combustion chamber 18, the tool is ready for firing again upon re-depressing the trigger 72. Not shown is a start button to manually displace the diaphragm arrangement 34 to provide a fuel charge for the first operating cycle.

In the various embodiments described above, compression air pressure from below the tool piston or combustion air pressure from above the tool piston is used to displace an actuator diaphragm (piston) for opening a fill valve (or the valve ports of a fuel injector valve) and allowing a given amount of fuel to fill a fuel plenum (portion) chamber after the tool has been fired. The required actuator displacement could also be associated with the same air pressure changes by combining an air pressure sensor with a solenoid actuator or other sensor-mover combination. The sensor would sense the change in air pressure from above or below the piston to detect tool firing, and the solenoid actuator would operate in response to a signal from the sensor to open or close the fill valve (or the valve ports of a fuel injector valve). The fuel collected in the fuel plenum chamber is injected into the combustion chamber through a dump valve (or the dump valve ports of a fuel injector valve), which can be operated either manually or automatically. During the filling cycle of the fuel plenum chamber, the dump valve is closed. However, the dump valve can be opened manually such as by releasing the tool trigger or automatically such as by biasing the actuator diaphragm.

Thus, it is apparent that there has been provided in accordance with the invention a fuel injection system that fully satisfies the objects, aims, and advantages set forth above. While the invention has been described in conjunction with an illustrated embodiment thereof, it is evident that many alternatives, modifications, and variations will be apparent to those skilled in the art in light of the foregoing description.

I claim:

1. An automatic fuel injection system for linear engines comprising a combustion chamber, the power from which drives a piston for use for gas-powered tools, the system comprising:

a. a fuel source communicating through a fuel injection valve with the combustion chamber, the fuel injection valve moving between a first position allowing a charge of fuel from the source to pass into a fuel plenum and a second position allowing the charge of fuel in the plenum to pass into the combustion chamber; and b. an actuator for the injection valve responsive to compressed air associated with movement of the piston to move the fuel injection valve between the second position and the first position.

2. The system according to claim 1, whereby movement of the fuel injector valve into the first position blocks passage of the fuel from the fuel plenum to the combustion chamber.

3. The system according to claim 2, whereby movement of the fuel injector valve into the second position blocks passage of the fuel from the fuel source to the fuel plenum.

4. The system according to claim 1, wherein the actuator is biased into the second position, which in addition to allowing the charge of fuel in the plenum to pass into the combustion chamber also blocks passage of the fuel from the fuel source to the fuel plenum.

5. The system according to claim 1, wherein the actuator is a diaphragm actuator that is movable by the compressed air associated with the movement of the piston.

6. The system according to claim 5, wherein the diaphragm actuator is in communication with an air plenum that is pressurized by air displaced by the movement of the piston.

7. The system according to claim 1, wherein the fuel source communicates with a vaporization chamber which in turn communicates with a regulator where a predetermined volume of fuel is passed to the fuel plenum when the fuel injection valve is in its first position.

8. The system according to claim 7, wherein the fuel injection valve is further associated with a combustion chamber exhaust valve and arranged so that the exhaust valve is in a closed position when the fuel injection valve is in said second position.

9. The system according to claim 1, wherein the fuel injection valve is further associated with a combustion chamber exhaust valve and arranged so that the exhaust valve is in an open position when the fuel injection valve is in said first position.

10. The system according to claim 1, wherein a manual actuator is associated with the actuator to inject fuel into the combustion chamber for the first cycle of the tool.

11. The system according to claim 1, wherein the fuel injection valve comprises a pair of cooperating diaphragms, a first of the diaphragms movable under pressure from the compressed air associated with movement of the piston to a first position opening a first valve to enable a charge of fuel from the source to enter the fuel/portion chamber and a second of the diaphragms concurrently closing a second valve to prevent flow of fluid from the fuel plenum/portion chamber to the combustion chamber, and the diaphragm actuators moving concurrently to a second position where the first valve is closed and the second valve is open to permit the charge of fuel in the fuel plenum/portion chamber to pass to the combustion chamber.

12. The system according to claim 11, wherein the fuel plenum is formed by a space between the two diaphragms.

13. The system according to claim 11, wherein a combustion chamber exhaust valve is associated with the pair of diaphragms and is arranged (a) to be closed when the diaphragms are in said second position and (b) to be open when the diaphragms are in said first position to control venting of the combustion chamber.

14. The system according to claim 11, wherein the first valve is a tire valve type.

15. The system according to claim 11, wherein an air plenum communicating with the first diaphragm is pressurized by the air compressed beneath the piston.

16. The system according to claim 11, wherein a check valve/orifice combination is associated with the air flow to the actuating diaphragm and arranged so that the air flow passes through an orifice and past a check valve as the air pressure increases and only through the orifice as the air pressure decreases.

17. The system according to claim 11, wherein the diaphragms are normally urged by biasing means to said second position.

18. The system according to claim 1, wherein the actuator is a diaphragm actuator actuated by combustion gases from the combustion chamber to overcome a bias of the actuator normally keeping the injection valve in said second position.

19. The system according to claim 1, wherein the actuator is a diaphragm actuator actuated by compressed air produced by movement of the piston to overcome a bias of the actuator normally keeping the injection valve in said second position.

20. A fuel injection system for linear engines of gas-powered tools comprising:

a fill valve for controlling the flow of fuel to a fuel plenum;

a passageway for connecting the fuel plenum to a combustion chamber;

a dump valve interrupting the passageway to the combustion chamber for controlling the flow of fuel from the fuel plenum to the combustion chamber; and an actuator responsive to air pressure changes generated by firing of the tool to operate at least one of the fill and dump valves.

21. The system of claim 20 in which the fill valve is opened and the dump valve is closed in association with an increase in air pressure generated by the firing of the tool.

22. The system of claim 21 in which the dump valve is opened and the fill valve is closed in association with a subsequent decrease in the air pressure generated by the firing of the tool.

23. The system of claim 20 in which both the fill valve and the dump valve are movable together by the actuator between a first position at which the fill valve is open and the dump valve is closed and a second position at which the fill valve is closed and the dump valve is open.

24. The system of claim 23 in which the actuator is biased to the second position and is movable to the first position by the increase in air pressure generated by the firing of the tool.

25. The system of claim 24 in which the increase in air pressure is generated by movement of a piston within a combustion chamber.

26. The system of claim 20 in which the actuator is one of two actuators for separately operating the fill and dump valves.

27. The system of claim 26 in which a first of the actuators provides for automatically opening and closing the fill valve in response to the changes in air pressure generated by the firing of the tool.

28. The system of claim 27 in which a second of the actuators provides for manually closing and opening the dump valve in response to movements of a tool trigger.

29. The system of claim 28 in which the dump valve is closed in response to depressing the trigger for firing the tool and the dump valve is opened in response to releasing the trigger in advance of a subsequent firing of the tool.

30. The system of claim 27 in which the first actuator provides for automatically opening and closing the fill valve together with an exhaust valve of the combustion chamber.

* * * * *